US008459766B2

(12) United States Patent
Shinohara et al.

(10) Patent No.: US 8,459,766 B2
(45) Date of Patent: Jun. 11, 2013

(54) PRINT APPARATUS AND CONTROL METHOD THEREOF

(75) Inventors: Shimpei Shinohara, Yokohama (JP); Seiji Ogasawara, Machida (JP); Atsushi Takahashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 119 days.

(21) Appl. No.: 13/216,105

(22) Filed: Aug. 23, 2011

(65) Prior Publication Data

US 2012/0050361 A1 Mar. 1, 2012

(30) Foreign Application Priority Data

Aug. 27, 2010 (JP) ..... 2010-191206

(51) Int. Cl.
*B41J 29/38* (2006.01)

(52) U.S. Cl.
USPC ..... 347/9; 347/14; 347/16; 347/101

(58) Field of Classification Search
USPC ..... 347/9, 14, 16, 19, 22, 23, 29, 30, 347/31, 33, 101, 104, 105
See application file for complete search history.

(56) References Cited

U.S. PATENT DOCUMENTS 5,832,190 A * 11/1998 Terajima et al. ..... 358/1.14
6,435,649 B2 * 8/2002 Takahashi et al. ..... 347/33
2006/0077242 A1 * 4/2006 Takeishi et al. ..... 347/101

FOREIGN PATENT DOCUMENTS

JP 2006-88389 A 4/2006

* cited by examiner

*Primary Examiner* — Juanita D Jackson
(74) *Attorney, Agent, or Firm* — Canon USA Inc. IP Division

(57) ABSTRACT

A first rotator is provided on an upstream side of the carriage that holds a print head and a second rotator is provided on a downstream side of the carriage. The print head is allowed to move to a maintenance unit in a first state in which a sheet is in contact with both the first rotator and the second rotator during printing. The print head is not allowed to move to the maintenance unit in a second state in which the sheet is in contact with either one of the first rotator and the second rotator and the sheet is not in contact with the other rotator during printing.

10 Claims, 8 Drawing Sheets

PRINT APPARATUS AND CONTROL METHOD THEREOF

BACKGROUND OF THE INVENTION

1. Field of the Invention

The present invention relates to a print apparatus of a serial printing method.

2. Description of the Related Art

A print apparatus of a serial printing method is known in which a carriage on which a print head is mounted reciprocates to perform printing. If a side edge of a sheet to be used rises, the print head may hit the edge of the sheet when the carriage passes over the edge. If the hit occurs, there is a risk that the sheet is tangled with the carriage to cause a sheet conveyance jam or the print head is damaged.

To cope with the problem, an apparatus disclosed in Japanese Patent Laid-Open No. 2006-88389 presses down the sheet by the bottom surface of the carriage even if the sheet rises by employing a positional relationship in which the bottom surface of the reciprocating carriage does not run off the edge of the sheet. Thereby, the print head is prevented from hitting the edge of the sheet.

A print head requires periodic maintenance. For example, an ink jet print apparatus does not always use all nozzles for printing, so the inside of nozzles that do not eject ink frequently may dry to cause ejection failures. To avoid this, when the print head reciprocates to perform printing, a maintenance operation of nozzles called "preliminary ejection" is performed once for every predetermined number of times of printing or once for every predetermined period of time. In addition, maintenance operations such as an ink suction operation in which nozzles are capped and ink in the nozzles are sucked while printing is performed and a wiping operation for wiping a surface on which nozzles are formed may be performed.

If a maintenance unit is provided in the apparatus disclosed in Japanese Patent Laid-Open No. 2006-88389, it is necessary to provide the maintenance unit at a position apart from a recording area. Therefore, when the print head is moved to the maintenance unit, the bottom surface of the carriage is apart from the sheet, so the print head may hit the edge of the sheet when the print head returns to the recording area.

SUMMARY OF THE INVENTION

The present invention is made in view of the problem described above. The present invention provides a print apparatus and a control method thereof capable of preventing the carriage from hitting a side edge of the sheet during printing and reducing the possibility of conveyance jam of the sheet and a damage of the print head.

The print apparatus of the present invention includes a carriage configured to hold a print head and reciprocate in a second direction crossing a first direction in which a sheet is conveyed, a first rotator configured to come into contact with at least a surface of the sheet facing the print head on an upstream side of the carriage, a second rotator configured to come into contact with at least the surface of the sheet on a downstream side of the carriage, a maintenance unit configured to be disposed outside an area through which the sheet passes in the second direction and to perform maintenance of the print head, and a control unit configured to control movement of the carriage so that the print head is allowed to move to the maintenance unit in a first state in which the sheet is in contact with both the first rotator and the second rotator during a print operation and the print head is not allowed to move to the maintenance unit in a second state in which the sheet is in contact with either one of the first rotator and the second rotator and the sheet is not in contact with the other rotator during a print operation.

According to the present invention, when performing print on a leading edge portion or a trailing edge portion of a sheet, in a state in which one of the rotation bodies disposed in the upstream and the downstream of the carriage is not in contact with the sheet, the carriage cannot move away from the sheet to the maintenance unit. Therefore, it is possible to prevent the carriage from hitting a side edge of the sheet and reduce the possibility of conveyance jam of the sheet and a damage of the print head.

Further features of the present invention will become apparent from the following description of an exemplary embodiment with reference to the attached drawings.

DESCRIPTION OF THE EMBODIMENT

Hereinafter, a print apparatus of an embodiment of the present invention will be described. The present invention can be applied not only to a single function printer but also to a multifunction device in which a copy function, a facsimile function, and the like are added to a print function.

Figure 1:
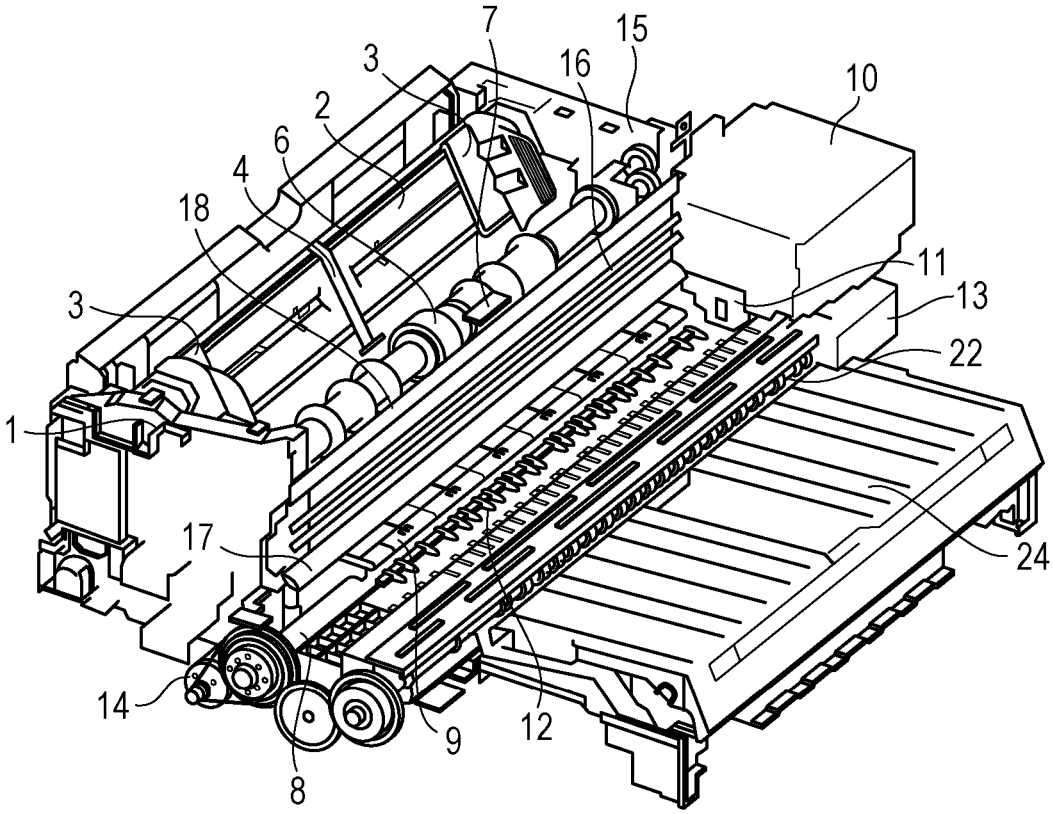
FIG. 1 is a perspective view of a print apparatus of an embodiment.
Figure 2:
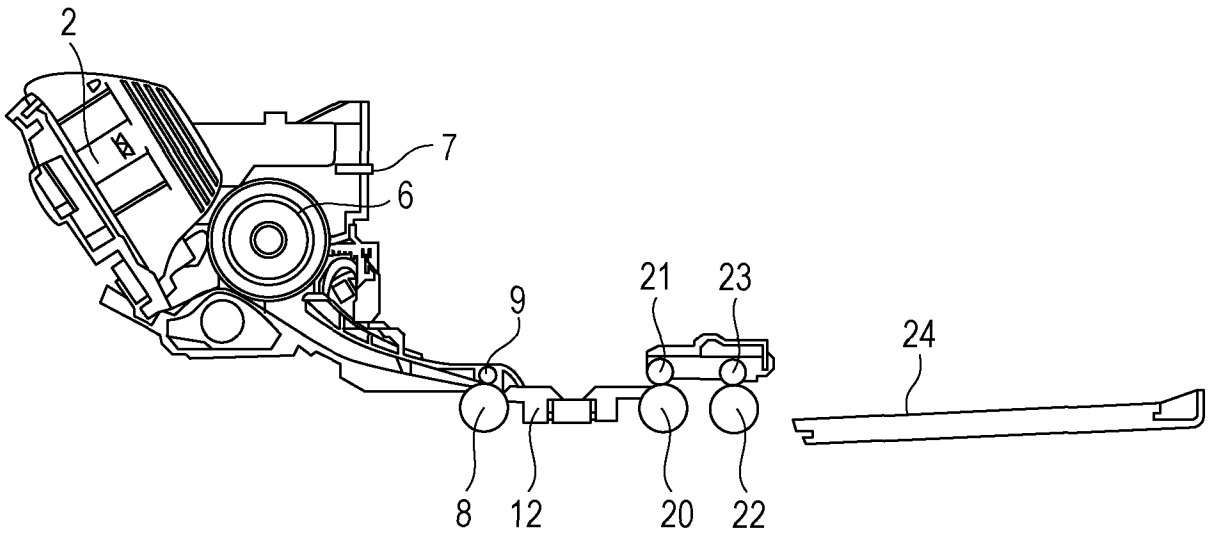
FIG. 2 is a cross-sectional view showing an internal configuration of the print apparatus.

FIG. 1 is a perspective view showing an internal configuration of the print apparatus of the embodiment. FIG. 2 is a cross-sectional view of FIG. 1. A sheet supply unit 2 is held on an apparatus frame 1, and a plurality of sheets cut into a predetermined size are loaded on a pressure plate included in the sheet supply unit 2. The sheet supply unit 2 is provided with two sliders 3 for positioning both sides of the sheets. A plurality of types and sizes of sheets can be selectively used in the print apparatus of the present example. The two sliders 3 are interlocked to slide relative to each other away from or toward a center position 4 so that the center of the sheets in the sheet width direction (X direction) is always set at the center position of the sheet supply unit 2 even if the sizes of the sheets are different. Such a method for setting the sheets so that the center of the sheets is set to the same center position 4 regardless of the sizes of the sheets to feed the sheets is hereinafter referred to as "center aligned". The sheets on the sheet supply unit 2 are fed by a feed roller 6 one by one, and the fed sheet reaches a conveying roller 8. A sensor 7 for detecting a leading edge or a trailing edge of the sheet is provided between the feel roller 6 and the conveying roller 8. In the center aligned, sheets having any size pass through the center position 4 in the X direction, so the position at which the sensor 7 detects the sheet is near the center position 4. In this specification, in the direction in which the sheet is conveyed during printing, the sheet supply unit 2 side is referred to as upstream and the side to which the printed sheet is discharged is referred to as downstream.

A print unit includes a print head 10, a carriage 11, and a platen 12. In the print head 10, nozzles are formed which correspond to a plurality of colors and eject ink by an ink jet method. In the print head 10, replaceable ink tanks corresponding to a plurality of colors are mounted. As the ink jet method, any method can be used, such as a method using a heater, a method using piezoelectric elements, a method using electrostatic elements, and a method using MEMS elements. The printing method is not limited to the inkjet method, but may be a method in which printing is performed by using a print head of other methods such as a thermal transfer method, a dye sublimation method, and a dot impact method.

The carriage 11 holds the print head 10 and reciprocates in X direction (second direction) crossing Y direction (first direction) in which the sheet is conveyed. The platen 12 supports the sheet on a support surface thereof and the support surface faces the nozzles of the print head 10 reciprocating with the carriage 11 with a predetermined gap in between. A rotational driving force of a carriage motor 15 is converted into linear movements and transmitted to the carriage 11 by a transmission mechanism including a pulley and a timing belt 16. The carriage 11 reciprocates while being guided by a guide shaft 17 and a guide rail 18.

In a range in which the carriage 11 can move along the X direction, a maintenance unit 13 for performing maintenance of the print head 10 is provided outside an area through which the sheet can pass. The area through which the sheet can pass is an area through which a sheet having a maximum sheet width that is assumed to be used passes, and no sheet exists outside the area. FIG. 1 shows a state in which the carriage 11 is located at the maintenance unit 13 disposed at an end of a movement stroke and the print head 10 faces the maintenance unit 13. The details of the maintenance unit 13 will be described below.

The conveying roller 8 provided on the upstream side of the carriage 11 in the conveying direction rotates by a rotational driving force of a conveying motor 14 transmitted by a timing belt. A driven rotating pinch roller 9 is urged to the conveying roller 8. The pinch roller 9 is divided into a plurality of small rollers along the direction of rotation shaft. The sheet is nipped by a conveying roller pair (referred to as a first rotator) including the rotating conveying roller 8 and the pinch roller 9, and the sheet moves in the Y direction on the support surface of the platen 12. A portion of the sheet on which an image is formed by the print head 10 is passed through the support surface of the platen 12 and discharged to the downstream side.

A conveying roller is also provided in the downstream side of the carriage 11 to discharge the sheet. In the present example, two roller pairs of conveying rollers are provided along the Y direction. One is a roller pair including a conveying roller 20 and a pinch roller 21 (referred to as a second rotator), and the other is a roller pair including a conveying roller 22 and a pinch roller 23 provided in the downstream side of the second rotator. The pinch rollers 21 and 23 are divided into a plurality of small rollers along the direction of rotation shaft. A driving force from the same driving source as that of the conveying roller 8 is transmitted to the conveying roller 22 and the conveying roller 23, and the conveying rollers rotate in synchronization with each other. In this way, the sheet is intermittently conveyed during printing by the first rotator in the upstream side of the carriage 11 and the second rotator in the downstream side of the carriage 11. A two-dimensional image is formed on the sheet by a serial print method in which conveyance (sub scanning) by the first rotator and the second rotator and reciprocating movement (main scanning) of the carriage 11 are repeatedly performed. The sheet on which an image is formed is discharged to be stacked on a tray 24.

The first rotator and the second rotator are not limited to rollers, but either or both of the rollers nipping the sheet from above and below may be a rotator such as a belt driving body. Or, either or both of the rollers may be a rotator such as a spur which intermittently comes into contact with the sheet. In this specification, the rotation bodies including those described above are referred to as rotator.

Figure 3:
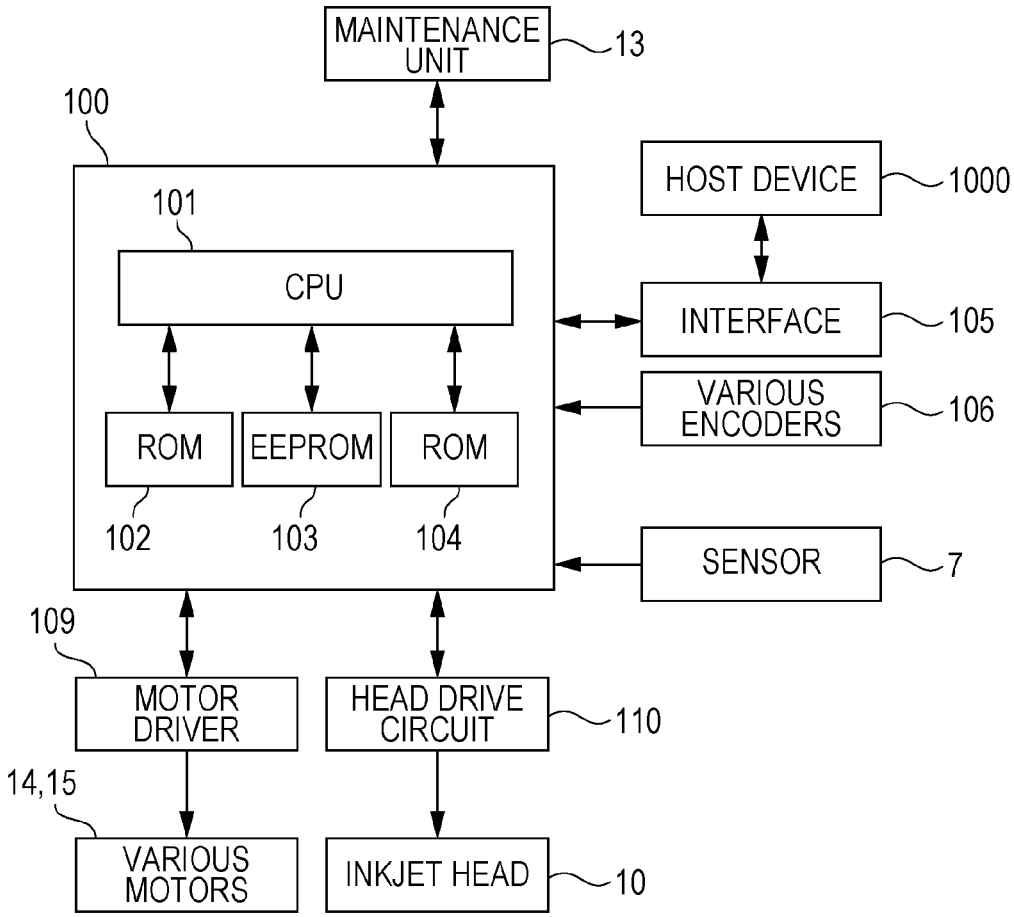
FIG. 3 is a block diagram showing a configuration of a control system.

FIG. 3 is a block diagram showing a configuration of a control system in the print apparatus of the embodiment. In a control unit 100 (controller), a CPU 101, a ROM 102, an EEPROM 103, and a RAM 104 are formed on a substrate. An interface 105 is, for example, a USB interface, which connects the control unit 100 to an external host device 1000 such as a PC and enables bi-directional communication based on a predetermined protocol. Detection results of a sensor 7 and encoders 106 are inputted into the control unit 100. The encoders 106 are a rotary encoder that detects rotation of the conveying roller 8 and a linear encoder that detects the position of the carriage 11. A motor driver 109 and a head drive circuit 110 are connected to the control unit 110. The motor driver 106 drives the conveying motor 14 and the carriage motor 15 on the basis of instructions from the control unit 100. The head drive circuit 110 individually drives a plurality of nozzles of the print head 10 and causes the nozzles to eject ink on the basis of instructions from the control unit 100. The control unit 100 also controls operation of the maintenance unit 13.

Figure 4:
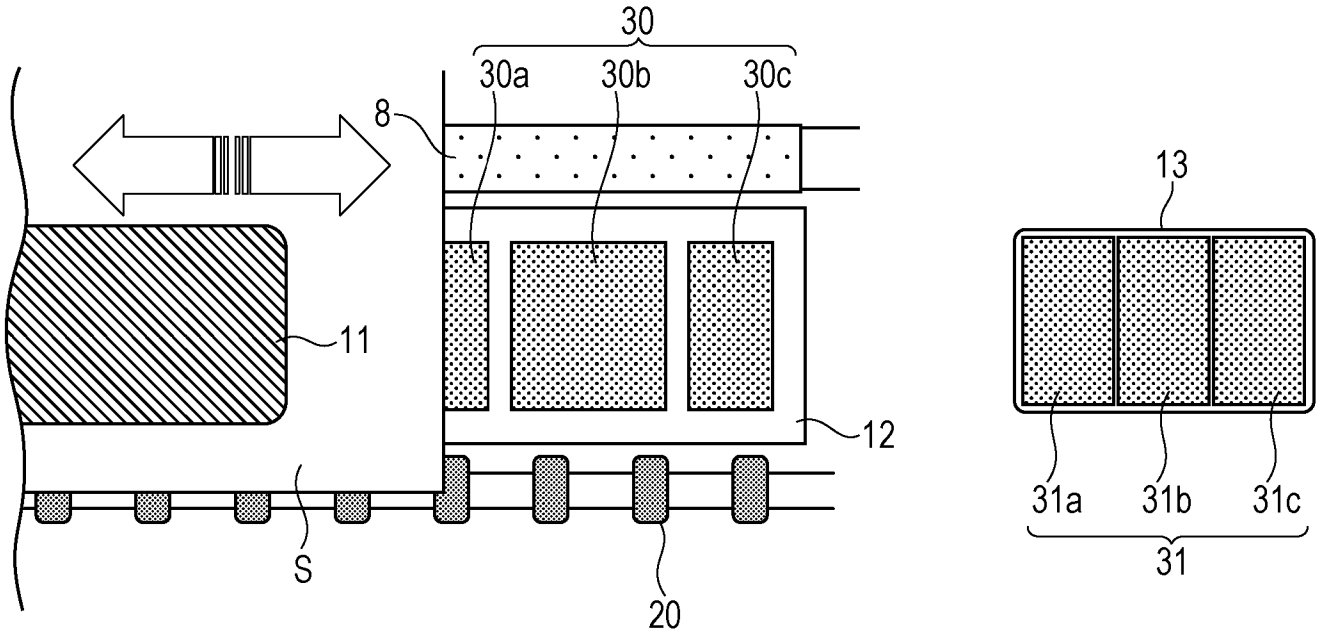
FIG. 4 is a top view showing a configuration around a moving range of a carriage.
Figure 5:
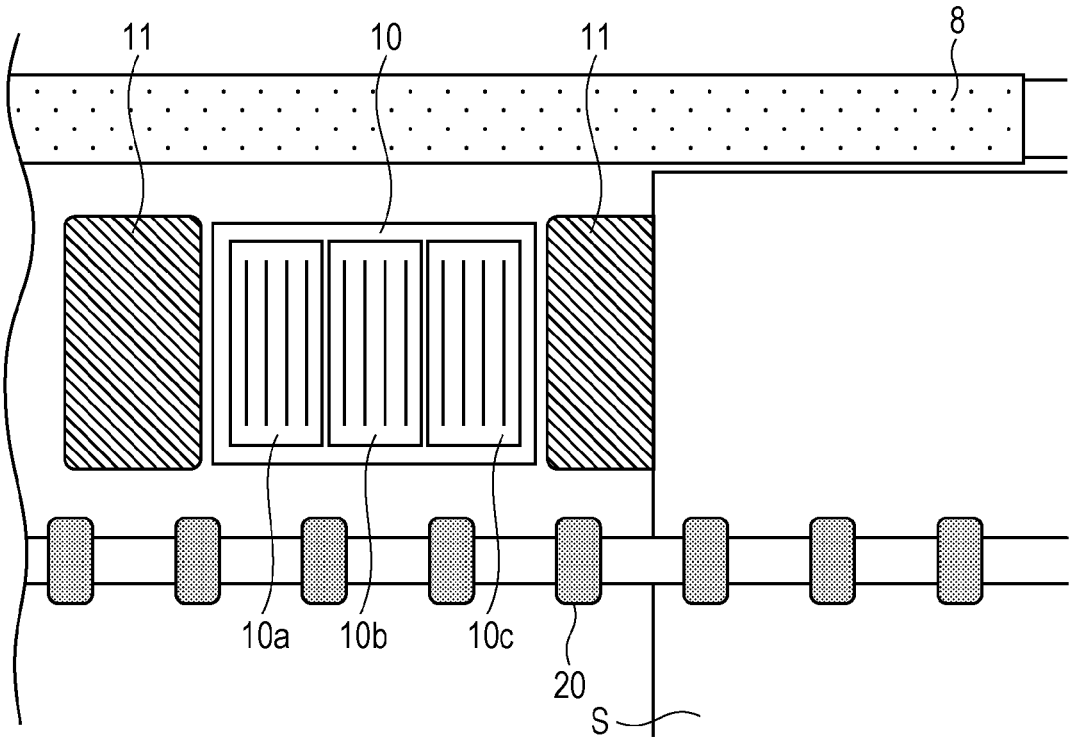
FIG. 5 is a bottom view of the configuration of FIG. 4.

FIG. 4 is a top view showing a configuration around a moving range of the carriage 11. FIG. 5 is a bottom view of FIG. 4. The bottom surface of the carriage 11 has a shape sandwiching nozzle surfaces (10*a*, 10*b*, and 10*c*) of the print head 10 held by the carriage 11 from both sides in the X direction. This reduces the probability that the sheet comes into contact with the nozzle surfaces, so that the nozzle surfaces are protected and the probability that ink unintentionally attaches the sheet is reduced.

Before printing and during a print operation, a maintenance operation known as a name of "preliminary ejection" for restoring or maintaining nozzle ejection performance of the print head 10 is performed. The preliminary ejection is an operation for periodically causing all the nozzles to eject ink at a position other than the sheet to restore or maintain ejection performance even if there are nozzles that are not frequently used. In the present example, there are a plurality of areas where the preliminary ejection is performed. One is areas provided on the platen 12 and the other is the maintenance unit 13 disposed outside the area through which the sheet can pass in the X direction. In the former one, an ink receiving unit 30 including absorbers is buried in a plurality of areas on the support surface of the platen 12. The ink receiving units 30 are provided to be located on both sides of a plurality of sheets that are assumed to be used according to the sizes of the sheets. One ink receiving units 30 includes three absorbers (30*a*, 30*b*, and 30*c*) respectively facing the three nozzle surfaces (10*a*, 10*b*, and 10*c*). The print head 10 ejects ink from the nozzles at this position in a state in which there is no sheet and causes the ink receiving unit 30 to absorb the ink. In the latter one, that is, the maintenance unit 13, the nozzles are covered by caps and ink is ejected while being sucked by a negative pressure so as to restore the nozzle ejection performance more strongly than by a simple ejection. An ink receiving unit 31 is provided on the top surface of the maintenance unit which faces the nozzles, and the ink received here is forcibly sucked and discharged. The ink receiving units 31 includes three caps (31*a*, 31*b*, and 31*c*) respectively facing the three nozzle surfaces (10*a*, 10*b*, and 10*c*). The print head 10 ejects a plurality of types of ink, and the degree of how easily the ink viscosity increases (viscosity increasing characteristics) is different depending on the types of ink. If a large amount of ink whose viscosity easily increases is ejected to the ink receiving unit 30, the ink is easily fixed to the absorbers and discharge passages of the ink receiving unit 30 and clogs them, so the preliminary ejection is performed on ink whose viscosity easily increases by forcibly ejecting the ink in the maintenance unit 13. To maintain a good image quality, the preliminary ejection at any appropriate position can be performed for every several carriage scans.

The maintenance operation in the maintenance unit 13 is not limited to the preliminary ejection, but may be other maintenance operations. For example, there are maintenance operations such as an ink suction operation in which nozzles are capped and ink in the nozzles are sucked and a wiping operation for wiping a surface on which nozzles are formed. The maintenance unit 13 may perform at least one of these maintenance operations.

Figure 6:
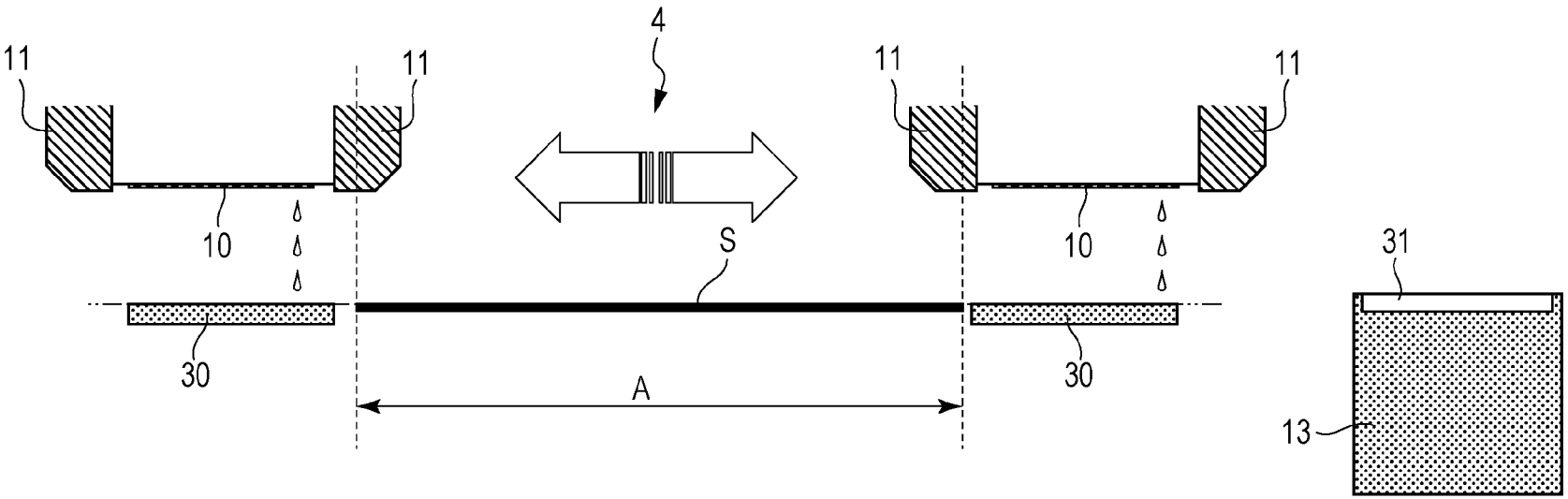
FIG. 6 is a horizontal cross-sectional view of the configuration of FIG. 4.

FIG. 6 is a cross-sectional view of the moving carriage 11 seen from the horizontal direction. A sheet S is fed so that the center of the sheet width is located at the center position 4. An area A in FIG. 6 is the sheet size (sheet width) of the sheet assumed to be used. During a print operation, the carriage 11 repeatedly reciprocates in the area A while ejecting ink from the print head 10 to the sheet. The ink receiving unit 30 is buried on both sides of the area A on the platen. The maintenance unit 13 is provided on the outside of the ink receiving unit 30. In the present example, it is assumed that a plurality of sheet sizes are used, and the area A and the ink receiving units 30 on both sides of the area A are provided for each size with the center position 4 at its center.

Figure 7A:
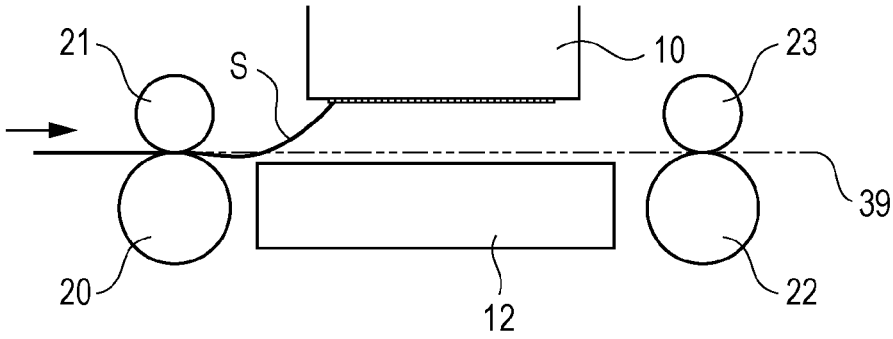
FIGS. 7A-7C are diagrams showing a situation in which a sheet is passing during a print operation.
Figure 7B:
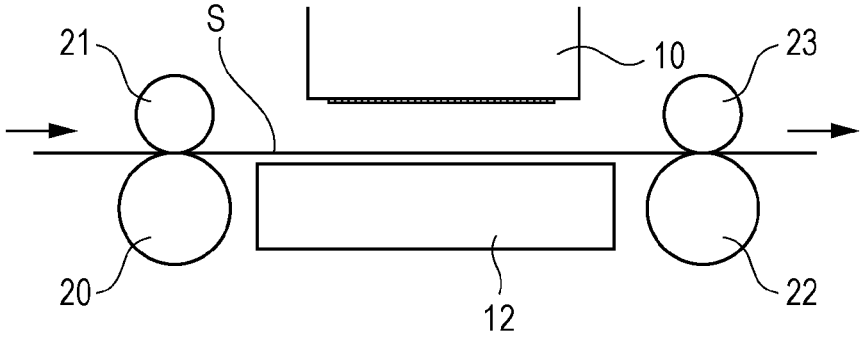
Figure 7C:
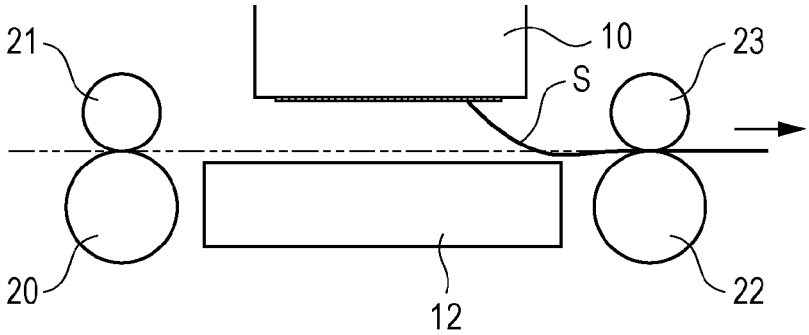

FIGS. 7A to 7C show a situation in which the sheet S sequentially passes through the first rotator (a pair of the conveying roller 20 and the pinch roller 21) and the second rotator (a pair of the conveying roller 22 and the pinch roller 23) during a print operation. The situation proceeds in order from FIG. 7A to FIG. 7B to FIG. 7C. FIG. 7A is a state in which only the leading edge portion of the sheet S is nipped by the first rotator, in other words, a state in which the first rotator is in contact with the sheet and the second rotator is not in contact with the sheet. FIG. 7B is a state in which the sheet S is nipped by both the first rotator and the second rotator, in other words, a state in which the sheet is in contact with both the first rotator and the second rotator. FIG. 7C is a state in which only the trailing edge portion of the sheet S is nipped by the second rotator, in other words, a state in which the second rotator is in contact with the sheet and the first rotator is not in contact with the sheet. Hereinafter, FIG. 7B is referred to as a first state and FIGS. 7A and 7C are referred to as a second state.

The basic idea of the control method of the present embodiment is to control so that the print head is allowed to move to the maintenance unit 13 in the first state and the print head is not allowed to move to the maintenance unit 13 in the second state. In the second state, the sheet is nipped by one of the first and the second rotation bodies and the sheet is not in contact with the other rotator, so the holding of the sheet is unstable. Therefore, there is a case in which the leading edge portion of the sheet rises from the support surface of the platen 12 as shown in FIG. 7A or the trailing edge portion of the sheet rises from the support surface of the platen 12 as shown in FIG. 7C.

In the case described above, if the carriage 11 moves to the maintenance unit 13, when the carriage 11 returns from the maintenance unit 13, the side surface of the carriage 11 hits the side edge of the rising sheet. If the hit occurs, the sheet may be crumpled and the carriage 11 may not move. To prevent the above situation from occurring, the movement of the carriage 11 is controlled so that the print head 10 is not allowed to move to the maintenance unit 13 in the second state.

The above situation occurs due to the fact that the sheet is fed in the center aligned. Specifically, in the center aligned, the smaller the sheet is, the larger the distance from the edge of the sheet to the maintenance unit is. Even if the maintenance unit 13 is provided to be adjacent to the edge of the sheet having the maximum size (the edge of the maximum recording area), the bottom surface of the carriage 11 easily runs off the sheet when a small size sheet is used.

When the print head 10 reciprocates on a rising sheet, if the print head reciprocates within a range of the area A in FIG. 6, the bottom surface of the carriage 11 continuously presses down the sheet, so the carriage 11 does not crumple the sheet. As an exceptional case, the size of the sheet S to be used is different from any sheet size assumed to be used and the sheet size is smaller than the area A. In this case, when the print head 10 is moved to the ink receiving unit 30, the bottom surface of the carriage 11 may run off the sheet S. Therefore, when the sheet to be used has a size smaller than allowed sizes, it is controlled so that the preliminary ejection on the ink receiving unit 30 is not allowed.

On the other hand, in the first state, the sheet S is nipped by both the first rotator and the second rotator. Therefore, the sheet is flatly supported on the support surface of the platen 12, so the sheet does not rise. More essentially, the top surface of the sheet (the surface facing the print head) is in contact with pinch rollers at two positions and the pinch rollers prevent the sheet from rising toward the print head. Therefore, the probability is low that the side surface of the carriage 11 hits the side edge of the sheet when the carriage 11 moves to the maintenance unit 13 and returns from the maintenance unit 13. Thus, in the first state, it is controlled so that the print head 10 is allowed to move to the maintenance unit 13.

In addition to the first state and the second state, there is a third state in which there is no sheet at both the first and the second rotation bodies. In the third state, there is no sheet below the print head 10, so the carriage 11 does not hit the sheet even when the carriage 11 moves. In the third state, it is not limited that the maintenance operation is performed in the maintenance unit 13. In the third state, the control unit controls the movement of the carriage 11 so that the print head 10 is allowed to move to the maintenance unit 13.

The problem described above may not appear depending on the type of the sheet to be used. For example, a sheet having high rigidity such as a thick photo paper is difficult to warp compared with a plain paper. Therefore, the print apparatus of the present embodiment can switch two modes according to the type of the sheet (in particular, rigidity). One of the two modes is a mode for controlling so that the print head 10 is prevented from moving to the maintenance unit 13 in the second state. The other mode is a mode for controlling so that the print head 10 is allowed to move to the maintenance unit 13 in both the first and the second states. If periodical maintenance is performed also at the leading edge and the trailing edge of the sheet during printing, a print result of very high quality can be obtained in a photo print or the like.

Figure 8:
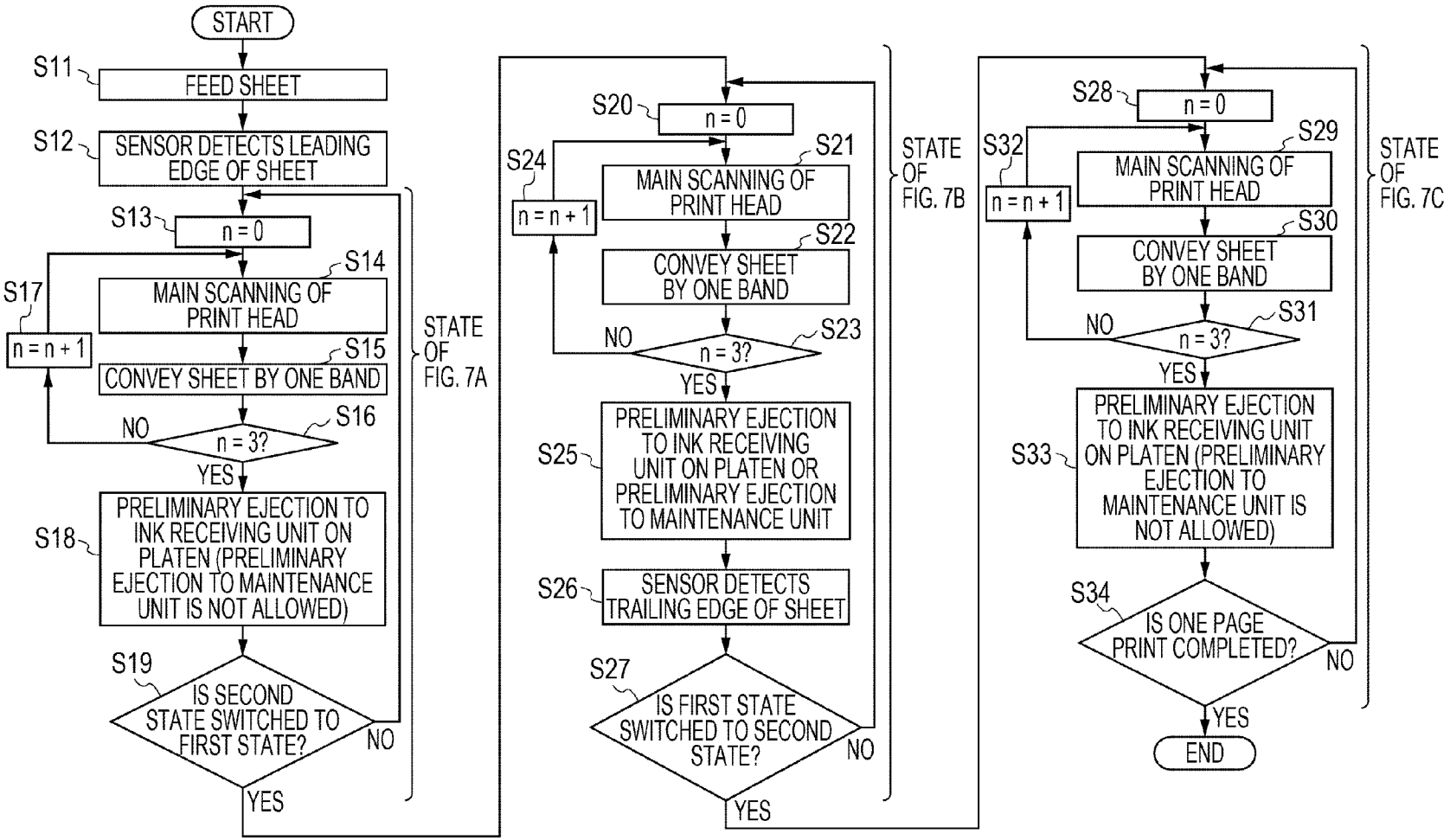
FIG. 8 is a flowchart showing an example of a print operation sequence.

A specific print operation sequence to realize the above idea will be described. The sequence is performed by the control of the control unit 100. FIG. 8 is a flowchart showing a procedure of the print operation sequence. Steps S13 to S19 represent a processing group corresponding to the second state in FIG. 7A. Steps S20 to S27 represent a processing group corresponding to the first state in FIG. 7B. Steps S28 to S34 represent a processing group corresponding to the second state in FIG. 7C.

When the sequence starts, in step S11, a sheet is fed from the sheet supply unit 2 to the first rotator. In step S12, the leading edge of the sheet is detected by the sensor 7. Thereafter, the position of the leading edge of the sheet is estimated on the basis of this detection timing.

When the leading edge of the sheet is nipped by the first rotator and comes under the print head 10, a print by the serial print method is started. Here, the sheet is in the second state as shown in FIG. 7A. In step S13, a counter included in the control unit is reset to n=0. In step S14, main scanning of the print head 10 is performed by the carriage 11 and a print corresponding to one band is performed. In step S15, the sheet is conveyed by one band by the first rotator. In step S16, it is determined whether the count value of the counter is n=3 (YES) or not (NO). If the determination is NO, the process moves to step S17 and the counter value is incremented as n=n+1. Then the process returns to step S14. If the determination of step S16 is YES, the process moves to step S18. Although, in the present example, the maintenance operation is performed once every four main scanning operations, it is not limited to this, and a threshold value of n may be a value other than 3 depending on the characteristics of the ink and the sheet to be used and an environmental condition such as temperature and humidity in an environment where the print apparatus is installed. The threshold value of n may be variable during printing depending on a recording condition such as a recording duty. In step S18, the preliminary ejection is performed on the ink receiving unit 30 on the platen 12 for nozzles corresponding to ink that is difficult to be fixed. In the second state, the preliminary ejection in the maintenance unit 13 is not allowed for nozzles corresponding to ink that is easily fixed. As described above, when the width of the sheet to be used is smaller than the area A, if the carriage 11 is moved to the ink receiving unit 30, the bottom surface of the carriage 11 may run off the sheet S. Therefore, when the sheet size in the width direction of the sheet S to be used is smaller than an allowed range, in step S18, the preliminary ejection on the ink receiving unit 30 is not allowed as well.

In step S19, it is determined whether the second state (FIG. 7A) is switched to the first state (FIG. 7B) (YES) or not (NO) following the conveyance of the sheet. The position where the leading edge of the sheet is located can be estimated by using the detection timing of the leading edge of the sheet in step S12 as a reference and an accumulated conveyance distance since the detection timing. If the determination is NO, the process returns to step S13 and the above processing is repeated. If the determination is YES, the process moves to step S20.

In step S20, the counter is reset to n=0. In step S21, main scanning of the print head 10 is performed by the carriage 11 and a print corresponding to one band is performed. In step S22, the sheet is conveyed by one band by the first rotator and the second rotator. In step S23, it is determined whether the count value of the counter is n=3 (YES) or not (NO). In the same manner as the above, the threshold value of n may be a value other than 3. If the determination is NO, the process moves to step S24 and the counter value is incremented as n=n+1. Then the process returns to step S21. If the determination of step S23 is YES, the process moves to step S25.

In step S25, the preliminary ejection is performed on the ink receiving unit on the platen 12 for nozzles corresponding to ink that is difficult to be fixed. In the first state, the sheet is stably supported on the platen, so the preliminary ejection in the maintenance unit 13 is allowed for nozzles corresponding to ink that is easily fixed. First, in FIG. 6, the preliminary ejection of certain nozzles is performed on the ink receiving unit 30 on the platen. Thereafter the carriage 11 is moved to the maintenance unit 13 and the preliminary ejection of other nozzles is performed in the maintenance unit 13.

In step S12, the trailing edge of the sheet is detected by the sensor 7. Thereafter, the position of the trailing edge of the sheet is estimated on the basis of this detection timing. Once the trailing edge of the sheet is detected, the detection thereafter is not necessary, so step 26 may be skipped.

In step S27, it is determined whether the first state (FIG. 7B) is switched to the second state (FIG. 7C) (YES) or not (NO) following the conveyance of the sheet. The position where the trailing edge of the sheet is located can be estimated by using the detection timing of the trailing edge of the sheet in step S26 as a reference and an accumulated conveyance distance since the detection timing. If the determination is NO, the process returns to step S20 and the above processing is repeated. If the determination is YES, the process moves to step S28.

Steps from S28 to S33 are the same as steps from S13 to S18 described above. The description of these steps is omitted. In step S34, it is determined whether the print of one page is completed (YES) or not (NO). If the determination is NO, the process returns to step S28 and the above processing is repeated. If the determination is YES, the sequence ends.

When the ink to be used is mainly made of a pigment, if the preliminary ejection is limited in the second state, a phenomenon called pigment regression may occur in which color density of the ink temporarily decreases. To prevent the phenomenon from occurring, by inserting the operation of the preliminary ejection in the maintenance unit 13 between step S19 and step S20, ink, the amount of which is larger than that ejected by normal preliminary ejection in the maintenance unit 13 in step S25, can be ejected. In other words, in the preliminary ejection performed for the first time after the second state is switched to the first state, it can be controlled so that ink, the amount of which is larger than that ejected by the preliminary ejection performed thereafter, is ejected. In the same manner, the same operation can be inserted after step S34.

According to the embodiment described above, in the second state in which the support of the sheet is unstable, it is controlled so that the carriage is not allowed to move beyond the width of the sheet (the area through which the sheet can pass). Thereby it is possible to prevent the carriage from hitting the side edge of the sheet during printing and reduce the possibility of conveyance jam of the sheet and a damage of the print head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-191206 filed Aug. 27, 2010, which is hereby incorporated by reference herein in its entirety.

What is claimed is:

1. A print apparatus comprising:

a carriage configured to hold a print head and reciprocate in a second direction crossing a first direction in which a sheet is conveyed;

a first rotator configured to come into contact with at least a surface of the sheet facing the print head on an upstream side of the carriage;

a second rotator configured to come into contact with at least the surface of the sheet on a downstream side of the carriage;

a maintenance unit configured to be disposed outside an area through which the sheet passes in the second direction and to perform maintenance of the print head; and a control unit configured to control movement of the carriage so that the print head is allowed to move to the maintenance unit in a first state in which the sheet is in contact with both the first rotator and the second rotator during a print operation and the print head is not allowed to move to the maintenance unit in a second state in which the sheet is in contact with either one of the first rotator and the second rotator and the sheet is not in contact with the other rotator during a print operation.

2. The print apparatus according to claim 1, wherein in the maintenance unit, at least one of preliminary ejection in which ink is ejected from nozzles of the print head, ink suction in which nozzles are capped and ink in the nozzles are sucked, and wiping in which a surface on which nozzles are formed is wiped is performed in a state in which the print head is moved to the maintenance unit.

3. The print apparatus according to claim 1, wherein a sheet is conveyed so that a center of the sheet in the second direction is aligned regardless of the size of the sheet to be used in the second direction.

4. The print apparatus according to claim 1, further comprising:

a sensor configured to detect at least one of a leading edge and a trailing edge of the sheet being conveyed, wherein the control unit determines whether the sheet is in the first state or in the second state on the basis of the detection of the sensor.

5. The print apparatus according to claim 1, wherein the control unit controls the movement of the carriage so that the print head is allowed to move to the maintenance unit in a third state in which the sheet is not in contact with either of the first rotator and the second rotator.

6. The print apparatus according to claim 1, wherein the control unit controls to switch a mode for controlling so that the print head is prevented from moving to the maintenance unit in the second state and a mode for controlling so that the print head is allowed to move to the maintenance unit in both the first state and the second state depending on a type of sheet to be used.

7. The print apparatus according to claim 1, wherein preliminary ejection in which ink is ejected from nozzles of the print head is performed at the maintenance unit, and in the preliminary ejection performed for the first time after the second state is switched to the first state, the control unit controls so that ink, the amount of which is larger than that ejected by the preliminary ejection performed thereafter, is ejected.

8. A print apparatus comprising:

a carriage configured to hold a print head and reciprocate in a second direction crossing a first direction in which a sheet is conveyed;

a first rotator configured to come into contact with at least a surface of the sheet facing the print head on an upstream side of the carriage;

a second rotator configured to come into contact with at least the surface of the sheet on a downstream side of the carriage;

a maintenance unit configured to be disposed outside an area through which the sheet passes in the second direction and to perform maintenance of the print head; and a control unit configured to control movement of the carriage so that the print head is allowed to move to the maintenance unit in a first state in which the sheet is in contact with both the first rotator and the second rotator during a print operation and the print head is not allowed to move to the maintenance unit in a second state in which the sheet is in contact with the first rotator and the sheet is not in contact with the second rotator during a print operation.

9. A print apparatus comprising:

a carriage configured to hold a print head and reciprocate in a second direction crossing a first direction in which a sheet is conveyed;

a first rotator configured to come into contact with at least a surface of the sheet facing the print head on an upstream side of the carriage;

a second rotator configured to come into contact with at least the surface of the sheet on a downstream side of the carriage;

a maintenance unit configured to be disposed outside an area through which the sheet passes in the second direction and to perform maintenance of the print head; and a control unit configured to control movement of the carriage so that the print head is allowed to move to the maintenance unit in a first state in which the sheet is in contact with both the first rotator and the second rotator during a print operation and the print head is not allowed to move to the maintenance unit in a second state in which the sheet is in contact with the second rotator and the sheet is not in contact with the first rotator during a print operation.

10. A control method of a print apparatus including a carriage configured to hold a print head and reciprocate in a second direction crossing a first direction in which a sheet is conveyed, a first rotator configured to come into contact with at least a surface of the sheet facing the print head on an upstream side of the carriage, a second rotator configured to come into contact with at least the surface of the sheet on a downstream side of the carriage, and a maintenance unit configured to be disposed outside an area through which the sheet passes in the second direction and to perform maintenance of the print head, the control method comprising:

controlling movement of the carriage so that the print head is allowed to move to the maintenance unit in a first state in which the sheet is in contact with both the first rotator and the second rotator during a print operation and the print head is not allowed to move to the maintenance unit in a second state in which the sheet is in contact with either one of the first rotator and the second rotator and the sheet is not in contact with the other rotator during a print operation.

* * * * *